US009066636B2

(12) United States Patent
Buell et al.

(10) Patent No.: US 9,066,636 B2
(45) Date of Patent: Jun. 30, 2015

(54) GRIT AND FOAM DISPENSER

(71) Applicants: Shelby J. Buell, Medina, OH (US); Chin P. Richards, Tallmadge, OH (US); Richard E. Corney, Akron, OH (US); Touby Khamphilapanyo, Garfield, OH (US)

(72) Inventors: Shelby J. Buell, Medina, OH (US); Chin P. Richards, Tallmadge, OH (US); Richard E. Corney, Akron, OH (US); Touby Khamphilapanyo, Garfield, OH (US)

(73) Assignee: GOJO Industries, Inc., Akron, OH (US)

( * ) Notice: Subject to any disclaimer, the term of this patent is extended or adjusted under 35 U.S.C. 154(b) by 71 days.

(21) Appl. No.: 13/800,680

(22) Filed: Mar. 13, 2013

(65) Prior Publication Data

US 2013/0341356 A1 Dec. 26, 2013

Related U.S. Application Data

(60) Provisional application No. 61/664,365, filed on Jun. 26, 2012.

(51) Int. Cl.

| | |
|---|---|
| ***B67D 7/70*** | (2010.01) |
| ***A47K 5/14*** | (2006.01) |
| *B05B 11/00* | (2006.01) |
| *B05B 7/00* | (2006.01) |

(52) U.S. Cl.

CPC ..... *A47K 5/14* (2013.01); *B05B 11/3087* (2013.01); *B05B 7/0018* (2013.01)

(58) Field of Classification Search

USPC ..... 222/135, 630, 631, 632, 633, 190, 137, 222/132, 23, 52, 637, 145.5

See application file for complete search history.

(56) References Cited

U.S. PATENT DOCUMENTS

| | | | | |
|---|---|---|---|---|
| 1,776,489 | A * | 9/1930 | Cobb | 222/633 |
| 4,180,160 | A | 12/1979 | Ogawa et al. | |
| 5,226,567 | A | 7/1993 | Sansalone | |
| 5,289,952 | A | 3/1994 | Gueret | |
| 5,353,961 | A | 10/1994 | Debush | |
| 5,779,161 | A | 7/1998 | Dvorak | |
| 5,836,482 | A * | 11/1998 | Ophardt et al. | 222/325 |
| 5,857,589 | A * | 1/1999 | Cline et al. | 222/1 |
| 5,894,967 | A | 4/1999 | Stahley et al. | |
| 5,975,360 | A * | 11/1999 | Ophardt | 222/83 |
| 5,975,364 | A | 11/1999 | Kaufman | |

(Continued)

FOREIGN PATENT DOCUMENTS

DE 4006987 A1 9/1991

OTHER PUBLICATIONS

"snorkel" Merriam-Webster.com. Merriam-Webster, Oct. 8, 2014.*

(Continued)

*Primary Examiner* — J. Casimer Jacyna
*Assistant Examiner* — Benjamin R Shaw
(74) *Attorney, Agent, or Firm* — Calfee, Halter & Griswold LLP

(57) ABSTRACT

One embodiment discloses a dispenser having a liquid container for holding a liquid, a liquid pump for moving the liquid from the liquid container to a first outlet, a grit container for holding grit, and an air pump for moving the grit from the container to a second outlet. The dispenser includes an actuator for actuating the liquid pump and the air pump. During operation, the liquid pump dispenses a liquid and the air pump causes air to flow through a first passageway into the grit container causing at least some grit to flow through a second passageway, out of the second outlet and into the liquid.

8 Claims, 4 Drawing Sheets

(56) References Cited

U.S. PATENT DOCUMENTS

| | | | | |
|---|---|---|---|---|
| 6,012,650 | A | 1/2000 | Hadar | |
| 6,079,871 | A | 6/2000 | Jonas et al. | |
| 6,082,586 | A * | 7/2000 | Banks | 222/95 |
| 6,131,771 | A | 10/2000 | Hanna | |
| 6,206,238 | B1 * | 3/2001 | Ophardt | 222/1 |
| 6,257,447 | B1 | 7/2001 | Schlienger et al. | |
| 6,609,634 | B2 | 8/2003 | De Laforcade et al. | |
| 6,620,125 | B1 | 9/2003 | Redl | |
| 6,715,645 | B2 | 4/2004 | Peuker et al. | |
| 6,749,091 | B2 | 6/2004 | Connelly et al. | |
| 6,877,924 | B1 | 4/2005 | Mears et al. | |
| 6,880,725 | B2 | 4/2005 | De Laforcade | |
| 6,938,798 | B2 | 9/2005 | Stradella | |
| 7,028,869 | B2 | 4/2006 | De Laforcade | |
| 7,063,235 | B2 | 6/2006 | Auer | |
| 7,066,355 | B2 | 6/2006 | Lewis et al. | |
| 7,066,357 | B2 | 6/2006 | Ciavarella et al. | |
| 7,137,531 | B2 | 11/2006 | Arghyris et al. | |
| 7,140,522 | B2 * | 11/2006 | Kress | 222/633 |
| 7,147,133 | B2 | 12/2006 | Brouwer et al. | |
| 7,451,895 | B2 | 11/2008 | Newton | |
| 7,661,561 | B2 * | 2/2010 | Ophardt et al. | 222/137 |
| 7,819,289 | B2 | 10/2010 | Willis | |
| 7,823,751 | B2 * | 11/2010 | Ophardt et al. | 222/137 |
| 7,832,024 | B2 | 11/2010 | Chow | |
| 8,002,151 | B2 * | 8/2011 | Matthews et al. | 222/190 |
| 8,083,103 | B2 | 12/2011 | LaFlamme et al. | |
| 8,281,956 | B2 | 10/2012 | Cadden | |
| 8,579,159 | B2 | 11/2013 | Ciavarella | |
| 2005/0205600 | A1 * | 9/2005 | Ophardt et al. | 222/1 |
| 2005/0258192 | A1 * | 11/2005 | Matthews et al. | 222/190 |
| 2006/0011655 | A1 * | 1/2006 | Ophardt | 222/190 |
| 2007/0289997 | A1 * | 12/2007 | Lewis et al. | 222/137 |
| 2009/0184134 | A1 * | 7/2009 | Ciavarella et al. | 222/135 |
| 2009/0199860 | A1 * | 8/2009 | Kress et al. | 132/201 |
| 2010/0067923 | A1 | 3/2010 | Arahira | |
| 2010/0102089 | A1 * | 4/2010 | Ophardt et al. | 222/137 |
| 2011/0017769 | A1 * | 1/2011 | Ophardt | 222/1 |
| 2011/0017786 | A1 | 1/2011 | Hamel et al. | |
| 2011/0079610 | A1 | 4/2011 | Kadyk et al. | |
| 2012/0085780 | A1 * | 4/2012 | Landauer | 222/52 |

OTHER PUBLICATIONS

International Search Report and Written Opinion from International Application No. PCTD/US2013/047240, date of mailing May 19, 2014.

"Grit in Foam The Science of Suspension," Industrial Survey, Deb Group, Aug. 2012, 4 pages.

* cited by examiner

GRIT AND FOAM DISPENSER

RELATED APPLICATIONS

This non-provisional utility patent application claims priority to and the benefits of U.S. Provisional Patent Application Ser. No. 61/664,365 filed on Jun. 26, 2012 and entitled GRIT AND FOAM DISPENSER. This application is incorporated herein by reference in its entirety.

TECHNICAL FIELD

The present invention relates generally to dispenser systems for dispensing liquids, foams, liquids with grit or foam with grit.

BACKGROUND OF THE INVENTION

Liquid dispenser systems, such as liquid soap and sanitizer dispensers, provide a user with a predetermined amount of liquid upon actuation of the dispenser. In addition, it is sometimes desirable to dispense the liquid in the form of foam by, for example, injecting air into the liquid to create a foamy mixture of liquid and air bubbles. Generally, liquid, or liquid in the form of a foam, is used for lightly soiled hands or objects. For heavily soiled hands or objects, it is desirable to dispense heavy duty soap or sanitizer to effectively clean the heavily soiled hands or objects. A heavy duty soap or sanitizer may be created by adding grit to the liquid. Adding grit to the liquid, however, may lead to problems with the dispenser clogging. In addition, it is difficult to make foam from a liquid having grit in it without clogging the dispenser.

SUMMARY

Exemplary embodiments of dispensers are disclosed herein. One embodiment discloses a dispenser having a liquid container for holding a liquid, a liquid pump for moving the liquid from the liquid container to a first outlet, a grit container for holding grit, and an air pump for moving the grit from the container to a second outlet. The dispenser includes an actuator for actuating the liquid pump and the air pump. During operation, the liquid pump dispenses a liquid through the first outlet and the air pump causes air to flow through a first passageway into the grit container and causes at least some grit to flow through a second passageway and out of the second outlet and into the liquid (or foam) being dispensed from the liquid outlet.

Exemplary embodiments of grit refill units for dispensers are disclosed herein. They may include a container for holding grit and an air pump for moving the grit. A first passageway extends between the air pump and the grit container, and a second passageway extends between the grit container and a grit outlet. In one embodiment, the container, the air pump and the first and second passageways form a single unit that may be inserted in a dispenser such that actuation of the dispenser causes grit to move from the container to the grit outlet by air pressure.

An exemplary grit and foam dispenser may include a receptacle for receiving a liquid refill unit. The liquid refill unit may include: a) a container for holding a foamable liquid; b) a liquid pump for moving the liquid; and c) a mixing chamber, wherein the mixing chamber includes an air inlet for receiving air to mix with the liquid to form a mixture that is dispensed as a foam. The dispenser also includes a receptacle for receiving a dry grit container and an air pump. A first passageway is provided between the air pump and the receptacle for receiving a dry grit container. The first passageway includes an end configured to extend into the grit container when a grit container is installed in the dispenser. A second passageway is provided that has a first end configured to extend into the grit container when a grit container is installed in the dispenser and a second end that at least partially forms an outlet for grit. An actuator for actuating the liquid pump and the air pump is provided and causes the dispenser to dispense a foam and grit mixture.

An exemplary method for providing a user with a source for a foam and grit cleanser may include providing a foamable liquid refill unit for a dispenser that includes a container and a liquid pump for moving the foamable liquid to a mixing chamber to be mixed with air and dispensed at a foam outlet as a foam. The method may further include providing a grit container for the dispenser wherein the grit container is configured to receive air from an air source to move grit from the grit container to a grit outlet. In one embodiment, the grit outlet is directed toward the foam outlet so that during operation grit dispensed from the grit outlet is directed into a side of the foam being dispensed from the foam outlet.

BRIEF DESCRIPTION OF THE DRAWINGS

These and other features and advantages of the present invention will become better understood with regard to the following description and accompanying drawings in which.

DETAILED DESCRIPTION

Figure 1:
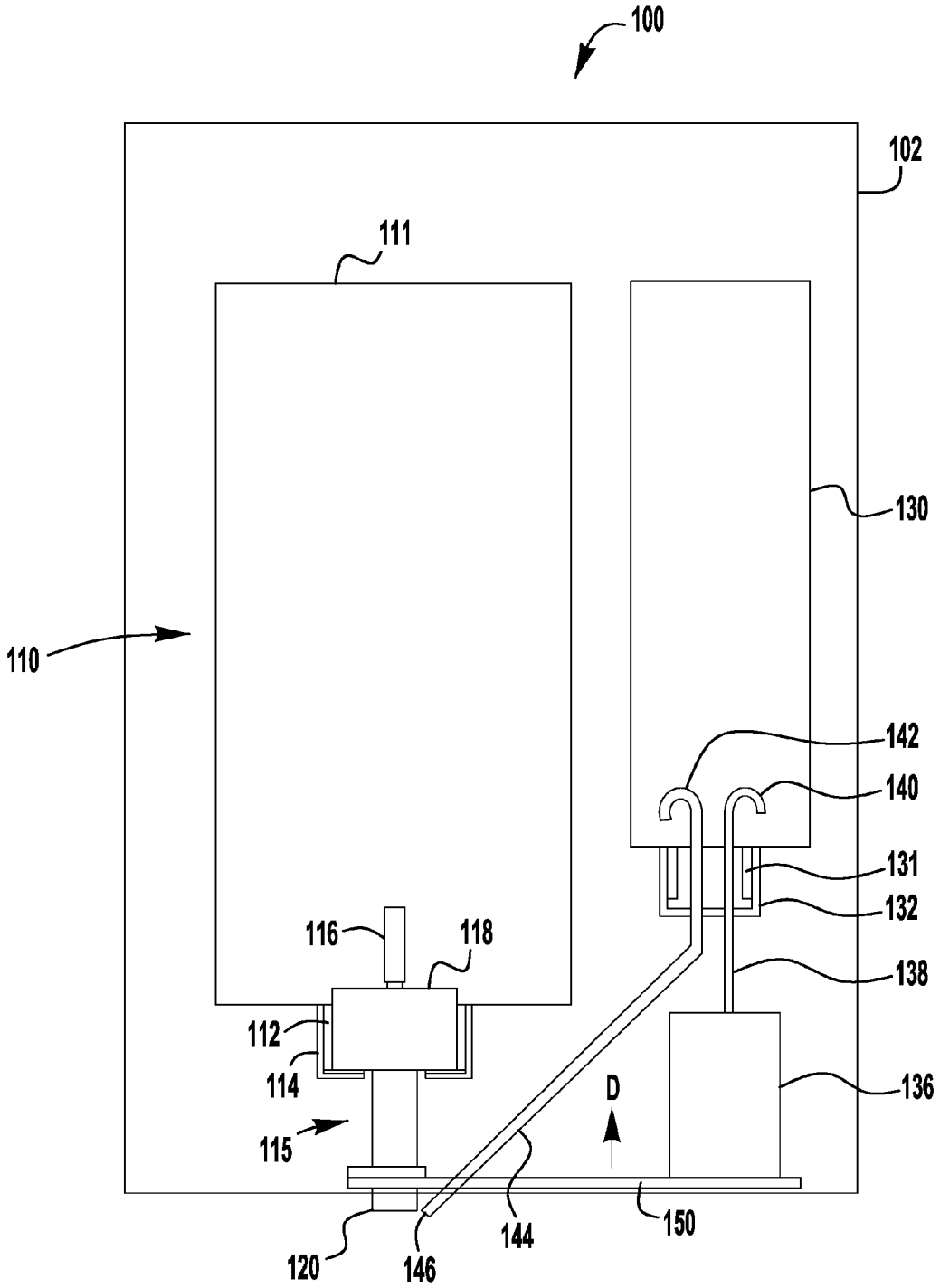
FIG. 1 illustrates a schematic view of a dispenser 100 in accordance with one exemplary embodiment of the present invention.

FIG. 1 is a exemplary embodiment of a foam and grit dispenser 100. The exemplary embodiment of the foam and grit dispenser 100 includes a dispenser housing 102. Dispenser housing 102 includes an actuator 150. Dispenser housing 102 may be any type of dispenser housing, such as, for example, the dispenser and housing detailed in U.S. Pat. No. 7,066,357, titled Wall-Mounted Dispenser Assembly with Transparent Window, which is incorporated herein in its entirety by reference. Modifications may need to be made to such a dispenser to cause the actuator to actuate a second air pump and to hold a grit container.

Located inside of dispenser housing 102 is a foamable liquid refill unit 110. Foamable liquid refill unit 110 is connected to housing 102 by a receptacle (not shown) that releasably holds foamable liquid refill unit 110 in place. Foamable liquid refill unit 110 includes a container 111, a neck 112 (neck 112 has threads not shown), and a foam pump 115 that includes a liquid pump 116 and an air pump 118. Foam pump 115 is connected to container 111 by cap 114. Refill unit 110 includes a foam outlet 120. In one embodiment, air pump 118 is separate from refill unit 110 and is attached to housing 102. In that embodiment, a connector connects the air pump to the refill unit when the refill unit is inserted in the dispenser.

Dispenser housing 102 includes a grit container 130 having a neck 131. Neck 131 has threads (not shown). Secured to neck 131 is a cap 132. Cap 132 includes two orifices therethrough. An air pump 136 is provided in dispenser housing 102. Air pump 136 is located so that it is actuated when the actuator 150 actuates the foam pump 115 by moving in direction D. Air pump 136 may be any air pump such as, for example, a bellows pump, a piston pump, a dome pump or a rotary pump. Air pump 136 may be permanently connected to dispenser housing 102, or may be connected to grit container 130 and removed with grit container 130.

Grit container 130 may be replaceable, refillable or both replaceable and refillable. In one embodiment, container 130 includes a cap (not shown) located on the upper portion of container 130 that may be removed to refill grit container 130 with grit. A first passageway 138 places air pump 136 in fluid communication with grit container 130. In one embodiment, first passageway 138 is a tube that extends from air pump 136 through cap 132 and into grit container 130. The end of first passageway 138 is a curved portion 140. Curved portion 140 forms a snorkel and the opening of first passageway 138 is located downward. A benefit to having the opening face downward is that grit from grit container 130 does not flow down first passageway 138 into air pump 136. Other options to prevent grit from flowing down first passageway 138 exist, such as, for example, the passageway could enter the grit container through the top or sides of the grit container. A second passageway 144 extends from the grit container 130 through cap 132 to an outlet 146. Outlet 146 may be a separate piece or may be the end of second passageway 144 or a combination thereof.

Second passageway 144 may include a curved, or snorkel portion 142 located in grit container 130 so that grit does not continue to flow due to gravity alone from grit container 130 to outlet 146. As discussed above, grit may be prevented from unintentionally flowing down second passageway 144 due to gravity alone by other means. Second passageway 144 may be any type of passageway and have any type of cross-section to facilitate flow of grit, such as for example, a circular cross-section, a rectangular cross-section or an oval shaped cross-section. In one embodiment, second passageway 144 is a tube.

Foam outlet 120 is directed so that foam dispensed from foam outlet 120 is directed downward. In one embodiment, grit outlet 146 is directed toward and below foam outlet 120 so that grit flowing out of grit outlet 146 strikes foam as foam is being dispensed from foam outlet 120. The grit mixes with or sticks to the foam which results in the user receiving a shot of a grit and foam mixture.

In one embodiment, dispenser 100 includes a plurality of actuators (not shown). In that embodiment, a user may move one actuator to receive a shot of foamed liquid, move another to receive a shot of grit, or move yet another to receive a shot that is a mixture of foamed liquid and grit. In one embodiment, refill unit 110 is not foamable and does not contain an air pump, but rather simply dispenses a liquid, such as soap. Dry grit may be propelled into the soap to form a soap and grit mixture.

Figure 2:
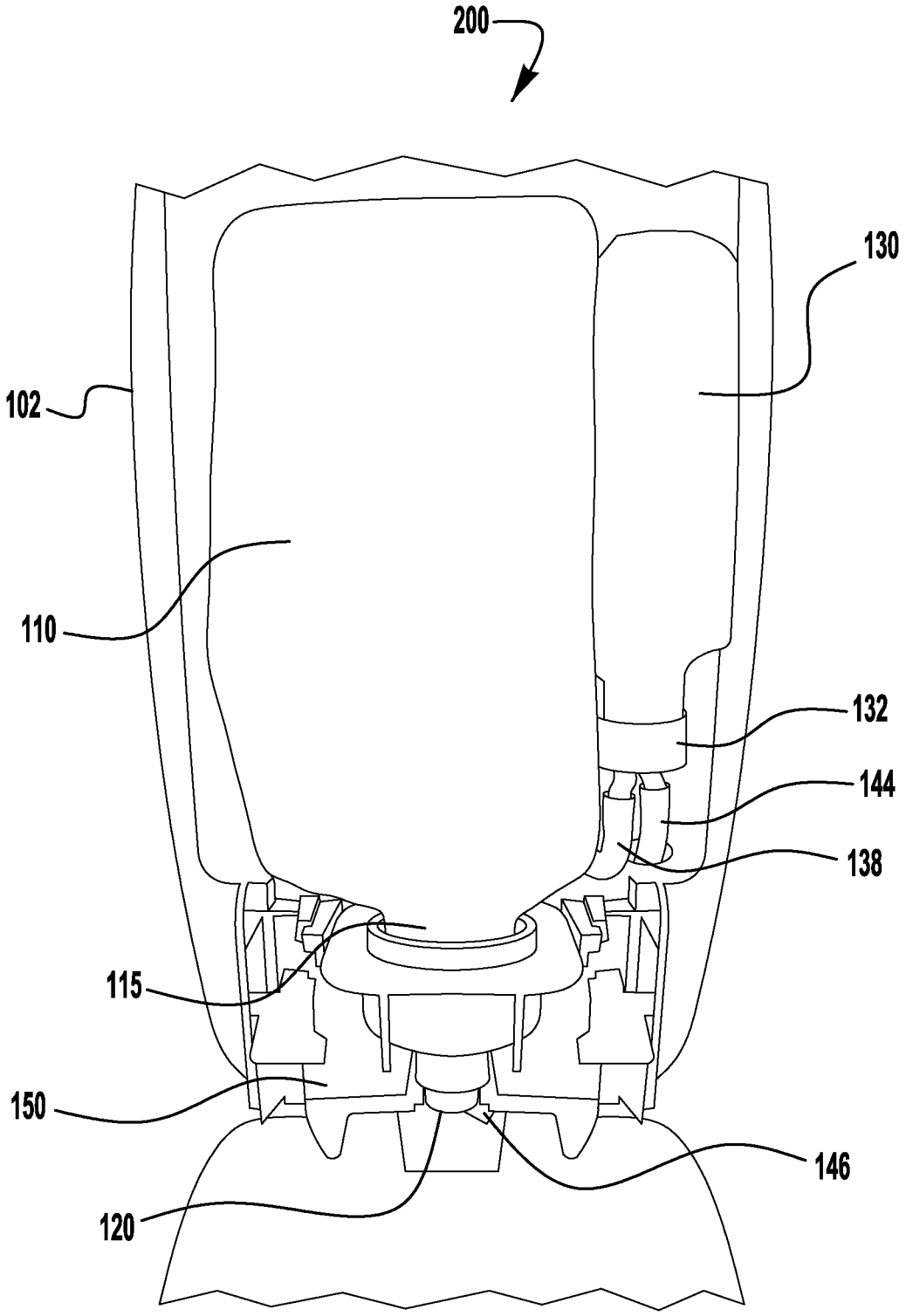
FIG. 2 illustrates an exemplary embodiment of a foam and grit dispenser 200 with a refill unit and a grit container installed in the dispenser.
Figure 3:
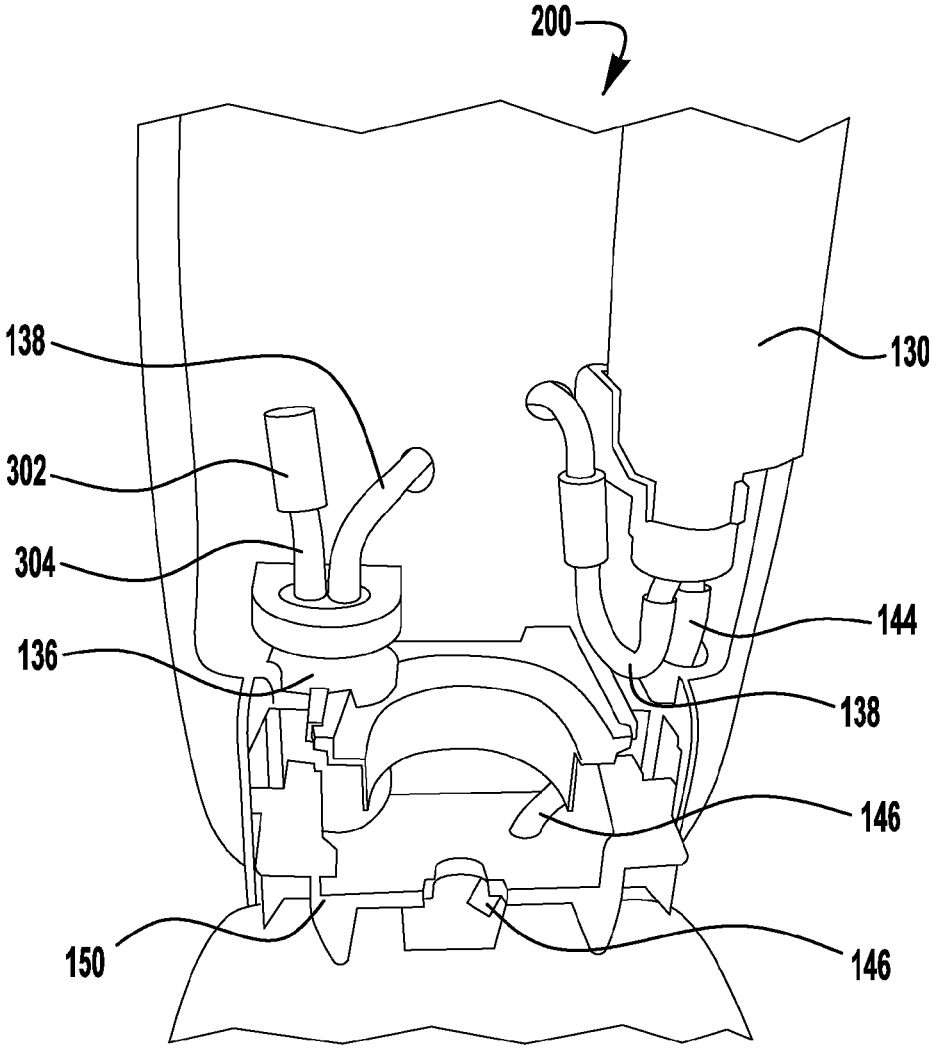
FIG. 3 illustrates the exemplary embodiment of a foam and grit dispenser 200 with the liquid refill removed from the dispenser.

FIGS. 2 and 3 illustrate an exemplary embodiment of a foam and grit dispenser 200. Foam and grit dispenser 200 includes a refill unit 110 that includes a foam pump 115. FIG. 2 illustrates the refill unit 110 inserted in the dispenser and FIG. 3 illustrates the dispenser without refill unit 110 installed. Grit container 130 is mounted in dispenser 200. An air pump 136 (FIG. 3) is located in the dispenser 200 so that upward movement of actuator 150 compresses the air pump 136. Air pump 136 includes an air inlet 304 and a one-way valve 302. One-way valve 302 allows air to recharge, or flow into, air pump 136 and prevents air from escaping air pump 136 through air inlet 304. In one embodiment, the grit container 130, air pump 136, first passageway 138 and second passageway 144 form a grit refill unit and may be replaced as a single unit.

Figure 4:
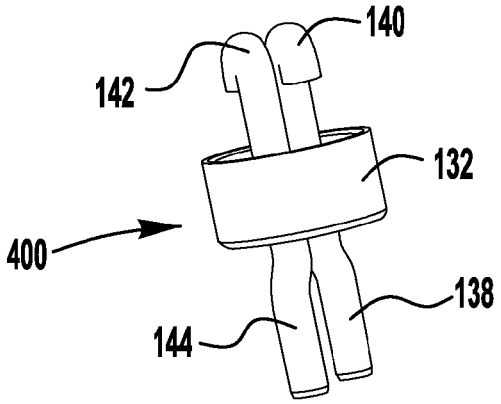
FIG. 4 illustrates an exemplary embodiment of grit dispensing component 400.

FIG. 4 illustrates and exemplary embodiment of a grit dispensing component 400. Grit dispensing component 400 includes a cap 132 that may be connected to a grit container 130. Air inlet tube 138 extends through cap 132 and terminates in an upside down "j" which forms a snorkel 140. Outlet passageway 144 extends through cap 132 and also has an upside down "j" shape which forms a snorkel 142.

In operation of an exemplary embodiment, actuator 150 is actuated and moved upward. Liquid flows from liquid pump 116 into a mixing chamber (not shown). Air is pumped from air pump 118 into the mixing chamber (not shown) where it combines with the liquid and is expelled out of the outlet 120 as a foam. Simultaneously, actuator 150 causes air pump 136 to pump air. The air travels through passageway 138, through snorkel 140 and into grit container 130. The burst of air mixes with grit and causes grit and air to flow up snorkel 142 into passageway 144 and out of outlet 146. Outlet 146 is angled so that grit flowing out of outlet 146 is directed into foam flowing out of foam outlet 120. The grit strikes the foam and combines with the foam to form a foam and grit mixture. Upon release of the actuator 150, air pump 136, liquid pump 116 and air pump 118 recharge and are ready for another dispense cycle.

Figure 5:
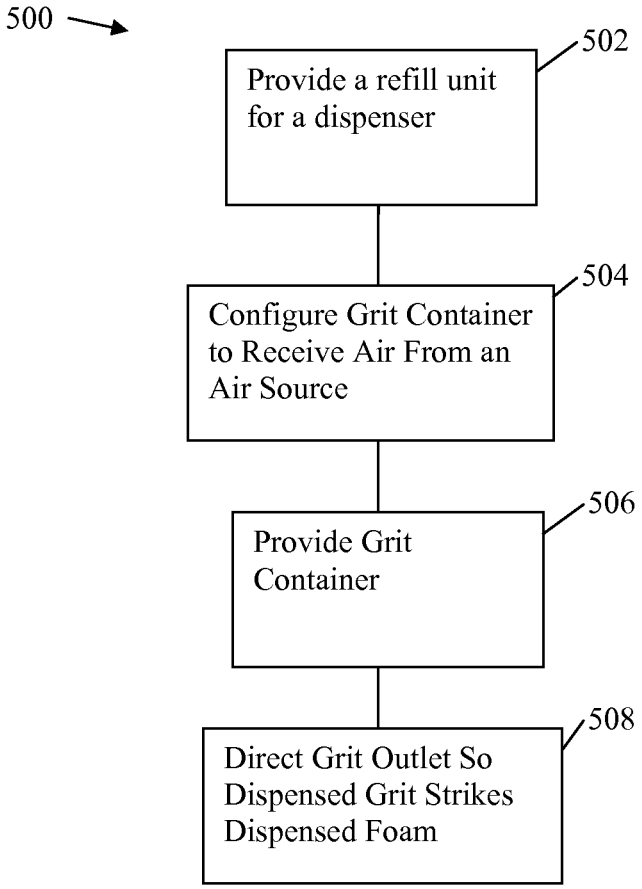
FIG. 5 illustrates an exemplary embodiment of a method for providing a foam and grit mixture.

FIG. 5 illustrates an exemplary method 500 for providing a user with a source of a foam and grit mixture. The embodiment may include providing a foamable liquid refill unit for a dispenser at block 502. The refill unit includes a container and a liquid pump for moving the foamable liquid to a mixing chamber to be mixed with air and dispensed at a foam outlet as a foam. At block 504, a grit container is configured to receive air from an air source to move grit from the grit container to a grit outlet. The grit container is provided at block 506. At block 508, a grit outlet is directed toward a foam outlet so that during operation grit dispensed from the grit outlet is directed into foam being dispensed from the foam outlet. Although the exemplary steps are presented in a certain order, it is contemplated that the steps may be performed in any order, and steps may be added or deleted without departing from the spirit and scope of the embodiments of the invention disclosed herein.

While the present invention has been illustrated by the description of embodiments thereof and while the embodiments have been described in considerable detail, it is not the intention of the applicants to restrict or in any way limit the scope of the appended claims to such detail. Additional advantages and modifications will readily appear to those skilled in the art. For example, a single air pump could be used to form the foam and move the grit. In addition, an electronic dispenser may be used to automatically dispense a foam and grit mixture when a user places his or her hands below the dispenser. In one exemplary embodiment, the dispenser has an optical sensor that can determine whether the user's hands are heavily soiled or lightly soiled. If the user's hands are heavily soiled, the dispenser automatically dispenses foam and grit. If the user's hands are not heavily soiled, the dispenser automatically dispenses foam without grit. Moreover, elements described with one embodiment may be readily adapted for use with other embodiments. Therefore, the invention, in its broader aspects, is not limited to the specific details, the representative apparatus and illustrative examples shown and described. Accordingly, departures may be made from such details without departing from the spirit or scope of the applicants' general inventive concept.

We claim:

1. A dispenser comprising:

a liquid container for holding a liquid;

a liquid pump for moving the liquid from the first container to a first outlet;

a grit container for holding grit;

an air pump;

a first passageway extending from the air pump to the grit container;

a second passageway extending from the grit container to a second outlet; and an actuator for actuating the liquid pump and the air pump;

wherein the air pump causes air to flow through the first passageway into the grit container and causes at least some grit to flow through the second passageway and out of the second outlet and a mixing chamber located downstream of the liquid pump and upstream of the first outlet, wherein the mixing chamber receives a liquid from the liquid pump and air from a second air pump and mixes the liquid and air to form a mixture that is dispensed at the first outlet in the form of a foam.

2. The dispenser of claim 1 wherein the second outlet is directed toward the first outlet so that the grit contacts the foam when the grit and foam are dispensed.

3. The dispenser of claim 1 wherein at least one of the first and second air pumps is attached to the container and remains attached to the container when at least one of the liquid and grit containers is removed from the dispenser.

4. The dispenser of claim 1 wherein the liquid container, the liquid pump, the mixing chamber and the air source form a replaceable refill unit.

5. The dispenser of claim 1 further comprising a first snorkel in fluid communication with the first passageway and a second snorkel in fluid communication with the second passageway, and where the first and second snorkels are located at least partially within the grit container.

6. The dispenser of claim 1 wherein the grit container is a container for dry grit.

7. The dispenser of claim 1 wherein the grit container is refillable.

8. A dispenser comprising:

a foam refill unit having a liquid container for holding a foamable liquid;

a liquid pump for moving the liquid from the first container to a first outlet; and a first air pump for mixing with the liquid prior to the first outlet to form a foam;

a grit container for holding grit;

an second air pump;

a first passageway extending from the second air pump to the grit container;

a second passageway extending from the grit container to a second outlet; and an actuator for actuating the liquid pump, first air pump and the second air pump;

wherein the second air pump causes air to flow through the first passageway into the grit container and causes at least some grit to flow through the second passageway and out of the second outlet.

* * * * *